United States Patent [19]

Esser

[11] Patent Number: 4,676,537

[45] Date of Patent: Jun. 30, 1987

[54] SLIDING DOOR LATCH STRIKE

[75] Inventor: Hans J. Esser, Keysborough, Australia

[73] Assignee: Ogden Industries Pty. Ltd., Victoria, Australia

[21] Appl. No.: 610,922

[22] Filed: May 15, 1984

[51] Int. Cl.[4] ..... E05B 15/02

[52] U.S. Cl. ..... 292/341.15; 292/341.17

[58] Field of Search ..... 292/341.15, 341.17, 292/169.13, 169.14

[56] References Cited

U.S. PATENT DOCUMENTS

| | | | |
|---|---|---|---|
| 1,479,744 | 1/1924 | Salata | 292/341.15 |
| 1,493,526 | 5/1924 | Freysinger | 292/341.17 |
| 2,424,782 | 7/1947 | Voight et al. | 292/169.13 |
| 2,645,926 | 7/1953 | Erkkila | 292/169.13 X |
| 2,699,204 | 1/1955 | Davis | 292/145 |
| 2,730,391 | 1/1956 | Rayburn | 292/169.13 |
| 2,804,327 | 8/1957 | Williams et al. | 292/169.13 |
| 3,279,836 | 10/1966 | Swanson | 292/169.13 |

FOREIGN PATENT DOCUMENTS 243222 2/1963 Australia .

*Primary Examiner*—Robert L. Wolfe
*Assistant Examiner*—Lloyd A. Gall
*Attorney, Agent, or Firm*—Berman, Aisenberg & Platt

[57] ABSTRACT

A latch strike for a sliding door and being cooperable with a locking bar which is pivotally mounted on the door and has a latching recess within an upper edge. The latch strike includes a housing having an opening for receiving the lock bar and a latch bolt movably mounted on the housing for movement between a latching position at which it is engagable within the latching recess and a delatching position at which it is not so engagable. A deadlocking lever is carried by the latch bolt and is movable relative thereto between an operative position at which it is engagable with an abutment to thereby prevent movement of the latchbolt out of its latching position, and an inoperative position at which it does not influence the latch bolt movement. A control member normally holds the deadlocking lever in its inoperative position and is responsive to location of the latch bar within the latching recess to free the lever for movement into its operative position.

8 Claims, 7 Drawing Figures

SLIDING DOOR LATCH STRIKE

This invention relates to strikes for sliding door latches of the kind in which a lock bar is pivotally mounted on the door for movement between a lock position in which it cooperates with a spring influenced latch bolt of the strike assembly and a release position in which it does not cooperate with that bolt. Such a latch is disclosed by Australian Pat. No. 243222.

BACKGROUND

Sliding door latches of the foregoing kind can suffer from lack of security if the door is not held close against the door jamb containing the strike when in the closed condition. If a gap exists between the latch face plate and the strike, it is possible to insert a piece of wire into the strike cavity and thereby push the latch bolt out of engagement with the lock bar.

SUMMARY OF THE INVENTION

It is an object of the present invention to provide a latch strike of the kind indicated which is relatively secure even if a gap as described exists in an associated door assembly.

According to the present invention, there is provided a sliding door latch strike including, a housing having a front plate and an opening through that plate for receiving the lock bar of a sliding door, a latch bolt mounted on said housing for movement between a latching position at which it is engagable within a latching recess of a said lock bar inserted through said opening and a delatching position at which it is not so engagable, spring means urging said latch bolt into said latching position, and a deadlocking mechanism connected to said latch bolt and being responsive to latching engagement between said latch bolt and said lock bar to prevent movement of the latch bolt into said delatching position.

DETAILS

The essential features of the invention, and further optional features, are described in detail in the following passages of the specification which refer to the accompanying drawings. The drawings, however, are merely illustrative of how the invention might be put into effect, so that the specific form and arrangement of the features (whether they be essential or optional features) shown is not to be understood as limiting on the invention.

Figure 1:
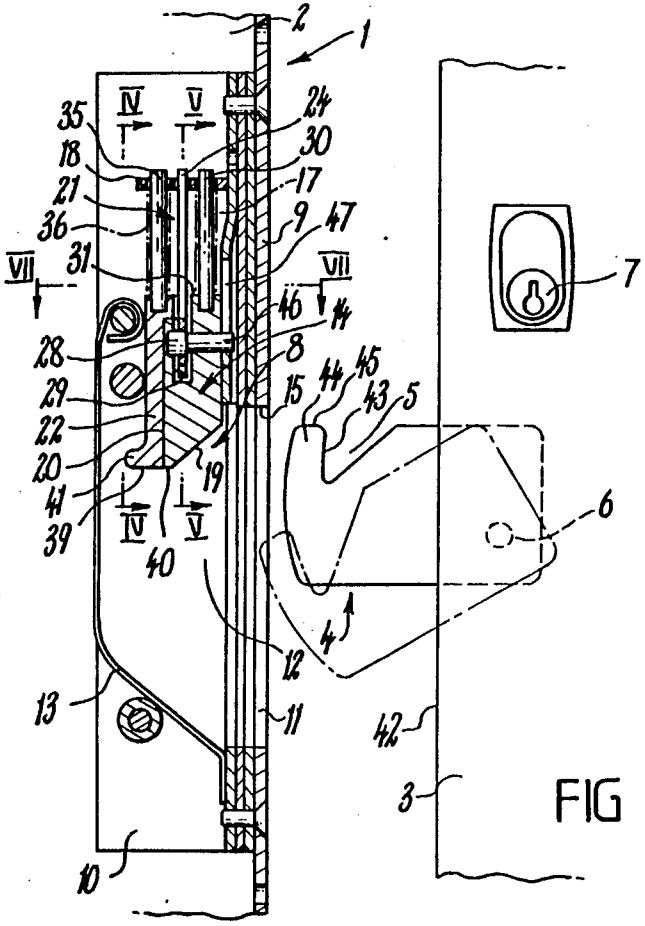
FIG. 1 is a partially sectioned side elevation view showing one embodiment of the invention in association with a sliding door.

In the example arrangement shown in FIG. 1, the strike assembly 1 is secured to a door jamb 2, and an associated sliding door 3 carries a lock bar 4. The lock bar 4 has a latching recess 5 in an upper edge and is movable about a pivotable mounting 6 under the control of a key actuated lock 7 to adopt either a lock position, as shown, or a release position. Such a lock bar construction is well known and requires no further description.

The particular strike assembly 1 as shown, includes a housing 8 having a front plate 9 and laterally spaced side plates 10 secured to that front plate 9. An opening 11 is provided through the front plate 9 and forms the entrance to a strike cavity 12 which is defined between the side plates 10. A shield plate 13 may close the rear of the cavity 12.

Figure 2:
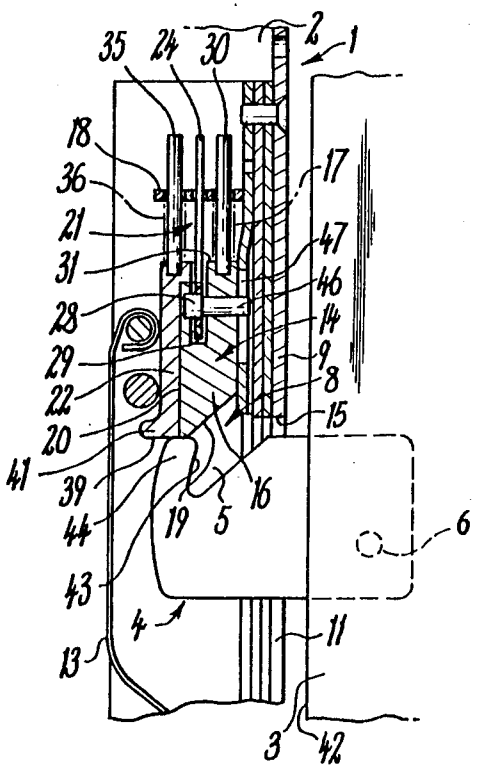
FIG. 2 is a view similar to FIG. 1 but showing the door approaching the closed position.

A latch bolt 14 is mounted between the side plates 10, usually adjacent the upper edge 15 of the cavity entrance 11, for movement between a latching position (FIG. 1) and a delatching position (FIG. 2). In the latching position, a head section 16 of the latch bolt 14 protrudes into the latch cavity 12-i.e., it protrudes below the upper edge 15 of the cavity entrance 11. In the delatching position, the head section 16 is withdrawn fully or substantially from its protrusion beyond the entrance upper edge 15. Biassing means 17 acts between the latch bolt 14 and a part 18 of the housing 8 to resiliently urge the bolt 14 into the latching position.

The head section 16 of the latch bolt 14 as shown has a sloping strike face 19 and an abrupt latching face 20. The strike face 19 is on a front side of the head section 16 adjacent to the cavity entrance 11 so as to be engagable by the lock bar 4 which will have a ramping effect against the face 19 such as to lift the latch bolt 14 against its biassing means 17. The latching face 20 is a substantially flat rear face of the head section 16 which is substantially parallel to the face plate 9.

Figure 5:
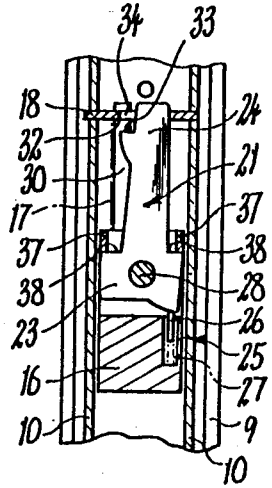
FIG. 5 is a cross sectional view taken along line V—V of FIG. 1.

The deadlatching mechanism for the assembly shown includes a deadlatching level 21 mounted on the latch bolt 14 for movement therewith and a control member 22 which is mounted within the housing 8 adjacent to the latch bolt 14. The deadlatching lever 21 has an end portion 23 pivotally attached to the latch bolt 14 and the lever 21 projects away from the bolt head section 16 in the general direction of the bolt movement (FIG. 5). The opposite end portion 24 of the lever 21 is cooperable with an abutment as hereinafter described. The lever 21 is pivotal relative to the latch bolt 14 between operative and inoperative positions in which it engages and does not engage respectively, the abutment (FIGS. 5 and 6).

The pivotal axis for the deadlatching level 21 extends transverse to the direction of movement of the latch bolt 14 and in the arrangement shown extends in the front to back direction of the strike assembly 1. Biassing means 25 (FIG. 5) urges the lever 21 towards its operative position and, as shown, may include a plunger pin 26 slidably mounted in part of the latch bolt 14 and influenced by a spring 27 to press against an edge of the lever 21 at one side of the lever pivot 28. Preferably, the plunger pin 26 is movable generally in the direction of the latch bolt 14 movement and engages against a lower edge of the lever 21. It is also preferred that the plunger pin 26 is mounted in the latch bolt head section 16 and that the pivoted end portion 23 of the lever 21 is located in a slot 29 (FIG. 1) provided in a body section of the latch bolt 14 from which the head section 16 projects.

Movement of the latch bolt 14 may be guided by one or more pins 30 projecting from the top side 31 of the latch bolt 14. Only one pin 30 is shown in the drawings and that slidably locates within a transverse wall 18 of the housing 8. The latch bolt biassing spring 17 surrounds the pin 30 and acts between the transverse wall 18 and the top side 31 of the latch bolt 14.

Figure 6:
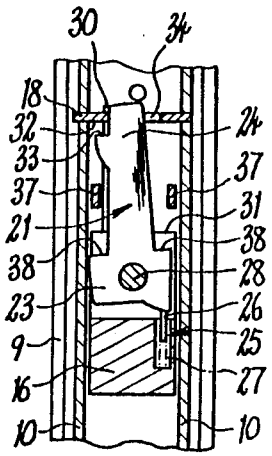
FIG. 6 is a view similar to FIG. 5 but showing the mechanism in a position corresponding to the condition shown in FIG. 3.

In the construction shown, the aforementioned lever abutment is formed by the undersurface 32 of the transverse wall 18 and a shoulder 33 provided on the upper end portion 24 of the deadlatching lever 21 is engageable with that surface 32 when the deadlatching lever 21 is in its operative position (FIG. 6). When the deadlatching lever 21 is in its inoperative position (FIG. 5), the upper end portion 24 of that lever 21 and the shoulder 33 are able to pass through an aperture 34 in the transverse wall 18.

The control member 22 as shown, is a plate-like member located against the rear side of the latch bolt 14 and is mounted within the housing 8 for relative movement in the same general direction as the latch bolt 14. The control member 22 may have one or more guide pins 35 similar to those of the latch bolt 14 and which also slidably locate within the transverse wall 18. At least one biassing spring 36 is arranged to urge the control member 22 in the same direction as the latch bolt 14 is biassed.

Figure 7:
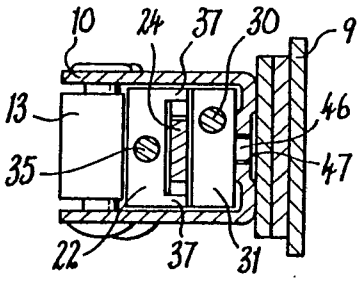
FIG. 7 is a cross sectional view taken along line VII—VII of FIG. 1.
Figure 4:
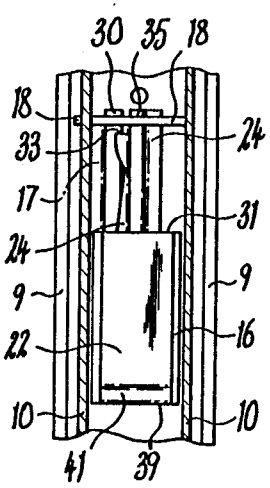
FIG. 4 is a view taken along line IV—IV of FIG. 1.

An upper part of the control member 22 is arranged to cooperate with the deadlatching lever 21 so as to normally hold that lever 21 in its inoperative position. In the construction shown, that part comprises two fingers 37 which extend from respective opposite sides of the control member 22 in a direction towards the front of the strikes housing 8 (FIG. 7). Each finger 37 extends over and is engagable with a respective upwardly facing shoulder 38 of the deadlatching lever 21 and each of those shoulders 38 is on a respective opposite side of the pivotal axis of that lever 21 (FIG. 5).

The arrangement is such that when each control member finger 37 engages its respective lever shoulder 38, the lever 21 is held in the inoperative position. In that regard, the bias on the plunger pin 26 is not sufficient to overcome the influence of the bias on the control member 22. The control member 22 is in its rest position when engaging the deadlatching lever 21 in the manner described and in that position a lower edge 39 of the control member 22 is preferably adjacent the lower edge 40 of the latch bolt head section 16. A laterally extending flange 41 may be formed along the control member lower edge 39 to provide an enlarged bearing surface for a reason hereinafter made clear.

As will be apparent from Pat. No. 243222, the lock bar 4 is pivotally mounted so as to be movable between locking and unlocking positions. In the locking position, the bar 4 projects from the adjacent door edge 42 so as to be insertable into the strike cavity 12, whereas in the unlocking position it is contained substantially within the body of the door 3. The latching recess 5 has an abrupt latching face 43 for cooperative engagement with the latching face 20 of the latch bolt 14. The part 44 of the lock bar 4 which defines the latching face 43 will be hereinafter referred to as the nose portion.

Assuming the lock bar 4 is in its locking position and the associated door 3 is moved towards its closed position, the lock bar 4 will enter the strike cavity 12 and bear against the sloping front face 19 of the latch bolt 14. As a result, the latch bolt 14 will be ramped upwards and the control member 22 will follow that movement because of its engagement with the deadlatching lever 21. Thus, the lever 21 will retain its inoperative position as it moves upward with the latch bolt 14 (FIG. 2).

Figure 3:
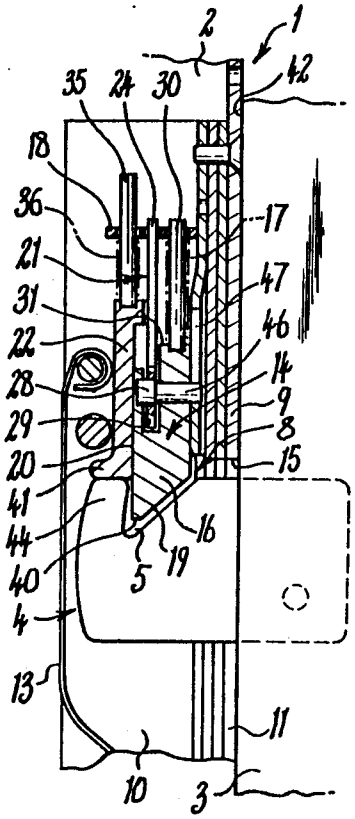
FIG. 3 is a view similar to FIG. 2 but showing the door in the fully closed position.

Closing movement of the door 3 therefore continues unimpeded and a position is reached at which the latch bolt 14 is located over the latching recess 5 of the lock bar 4 (FIG. 3). At that time, the spring 17 pushes the latch bolt 14 downwards so that its head section 16 locates within the latching recess 5 and thereby holds the door 3 against opening movement. The control member 22, however, cannot follow that movement of the latch bolt 14 because its lower edge 39 strikes the upper edge 45 of the lock bar nose portion 44. As a consequence, the deadlatching lever 21 is released from the influence of the control member 22 and is tilted into its operative position by the action of the plunger pin 26 (FIG. 6).

If an attempt is then made to improperly lift the latch bolt 14, the deadlatching lever 21 will engage the abutment surface 32 to prevent the latch bolt 14 being lifted to a position at which it clears the latcing recess 5 of the lock bar 4. Opening movement of the door 3 is therefore possible only by swinging the lock bar 4 into its unlocking position. When the lock bar 4 is swung downwards, the restraining influence on the control member 22 is removed and that member 22 is again able to move against the deadlatching lever 21 to hold it in the inoperative position (FIG. 5).

In the construction particularly shown, an axial extension 46 of the lever pivot pin 28 engages within a slot 47 of the housing to provide a limit stop for the latch bolt 14. As shown in FIG. 1, the pin extension 46 engages a lower end of the slot 47 to prevent movement of the latch bolt 14 substantially beyond the latching position.

It will be apparent from the foregoing description that the present invention provides an improved and secure strike for latches of the kind indicated. The deadlatching mechanism is effective and secure against tampering.

Various alterations, modifications and/or additions may be introduced into the constructions and arrangements of parts previously described without departing from the spirit or ambit of the invention as defined by the appended claims.

Having now described my invention what I claim as new and desire to secure by Letters Patent is:

1. A combination of a latch strike and a sliding door lock bar in which the lock bar is pivotally mounted for movement between an extended position and a retracted position and in which said lock bar has a latching recess in an edge thereof which is an upper edge of said lock bar in the extended position, the latch strike including a housing having a front wall, an opening through said front wall whereby said lock bar can be moved into and out of the housing, a latch bolt mounted on said housing behind the front wall thereof so as to be movable relative to the housing in a direction substantially parallel to said front wall, whereby the latch bolt can be moved between a latching position, at which it is exposed behind the opening so as to be engagable within the lock bar latching recess when the lock bar is inserted through said opening and is in said extended position, and a delatching position, at which it is not so exposed and engagable, spring means urging said latch bolt into the latching position, a deadlocking lever carried by said latch bolt for movement therewith and movable relative to said latch bolt between operative and inoperative positions, an abutment fixed to said housing so as to be engageable by said lever when the lever is in its operative position and thereby prevents movement of said latch bolt out of its latching position, a control member mounted on said housing for movement relative thereto and engagable with said lever to hold it in said inoperative position to allow movement of said lever past said abutment, the control member being engagable with said lock bar to be held thereby in a position at which it does not engage the lever and so permit said lever to adopt its operative position, and further spring means urging said control member towards a position at which it engages said lever, the arrangement being such that said lock bar must be pivoted away from said extended position thereof so as to be freed from the latching influence of said latch bolt.

2. A combination according to claim 1, wherein said control member is movable with said latch bolt between said positions thereof, said latch bolt and said lever move relative to said control member when the control member engages said lock bar, and engagement with the lock bar occurs as said latch bolt is moved towards said latching position.

3. A combination according to claim 1, wherein said lever is pivotably connected to said latch bolt for relative movement between said operative and inoperative positions, said pivotal connection includes a pin extending transverse to the direction of said latch bolt movement, and an axial extension of said pin cooperates with said housing to prevent movement of said latch bolt substantially beyond said latching position.

4. A combination according to claim 1, which comprises at least one guide one guide pin connected to said latch bolt and slidably located within a transverse wall of said housing, and said latch bolt spring means includes a coil compression spring located on said guide pin and interposed between said transverse wall and said latch bolt.

5. A combination according to claim 1, which further comprises to retain said control member in a normal position relative to said latch bolt during said latch bolt movement and at which said control member holds said lever against movement from its inoperative position, and said control member is engagable with said lock bar to be moved out of said normal relative position and thereby permit said lever to move into its operative position.

6. A combination according to claim 5, wherein said retaining means includes spring means urging said control member in one direction towards said lock bar engaging position, and an upper part of said control member is operative to prevent movement of said control member relative to said latch bolt in said one direction beyond said normal relative position.

7. A combination according to claim 6, wherein said upper part engages said lever and thereby holds said lever in the inoperative position.

8. A combination according to claim 6, wherein at least one guide pin is connected to said control member and slidably locates within a transverse wall of said housing, and said control member spring means includes a coil compression spring located on that guide pin and interposed between said transverse wall and said control member.

* * * * *